US008960241B2

(12) United States Patent
Dyer

(10) Patent No.: US 8,960,241 B2
(45) Date of Patent: Feb. 24, 2015

(54) CABLE TIE TENSIONING AND CUT-OFF TOOL

(75) Inventor: Edward P. Dyer, Germantown, WI (US)

(73) Assignee: HellermannTyton Corporation, Milwaukee, WI (US)

( * ) Notice: Subject to any disclaimer, the term of this patent is extended or adjusted under 35 U.S.C. 154(b) by 384 days.

(21) Appl. No.: 13/534,877

(22) Filed: Jun. 27, 2012

(65) Prior Publication Data

US 2013/0167970 A1 Jul. 4, 2013

Related U.S. Application Data

(60) Provisional application No. 61/503,403, filed on Jun. 30, 2011.

(51) Int. Cl.

| | |
|---|---|
| ***B21F 9/02*** | (2006.01) |
| ***B21F 9/00*** | (2006.01) |
| ***B26D 7/08*** | (2006.01) |
| ***B26D 7/14*** | (2006.01) |
| ***B25B 25/00*** | (2006.01) |
| ***B65B 13/02*** | (2006.01) |

(52) U.S. Cl.

CPC .. *B26D 7/08* (2013.01); *B26D 7/14* (2013.01); *B25B 25/00* (2013.01); *B65B 13/027* (2013.01)

USPC ..... 140/93.2; 140/123.6

(58) Field of Classification Search

USPC ..... 140/57, 93.2, 123.6

See application file for complete search history.

(56) References Cited

U.S. PATENT DOCUMENTS

| | | | |
|---|---|---|---|
| 3,531,822 | A | 10/1970 | Bush |
| 3,633,633 | A | 1/1972 | Countryman |
| 3,735,784 | A | 5/1973 | Obuch et al. |
| 3,782,426 | A | 1/1974 | Morgan et al. |
| 3,853,155 | A | 12/1974 | Kabel |
| 3,865,156 | A | 2/1975 | Moody et al. |
| 3,986,634 | A | 10/1976 | Smith et al. |
| 4,091,955 | A | 5/1978 | Sloan, Sr. |
| 4,093,005 | A | 6/1978 | Eberhardt et al. |
| 4,142,648 | A | 3/1979 | Johnson et al. |
| RE29,973 | E | 4/1979 | Paradis |
| 4,165,816 | A | 8/1979 | Tupper |
| 4,168,012 | A | 9/1979 | Hawkinson |
| 4,192,358 | A | 3/1980 | Bone |
| 4,299,102 | A | 11/1981 | Aro |
| RE30,996 | E | 7/1982 | Pobuta et al. |

(Continued)

FOREIGN PATENT DOCUMENTS

| | | |
|---|---|---|
| CA | 143621 | 8/2012 |
| CN | ZL201130506376.7 | 8/2012 |

(Continued)

OTHER PUBLICATIONS

International Search Report for PCT/US2012/044413, dated Jun. 27, 2012, 8 pages.

(Continued)

*Primary Examiner* — Teresa M Ekiert

(74) *Attorney, Agent, or Firm* — Ryan Kromholz & Manion, S.C.

(57) ABSTRACT

A hand held tool for the tensioning and severing of cable ties, including reciprocating means for tensioning the cable tie tail, locking means to prevent further tensioning upon the attainment of a preselected tension level in the tie tail, and severing means to sever the tie tail from the cable tie head.

12 Claims, 16 Drawing Sheets

(56) References Cited

U.S. PATENT DOCUMENTS

| | | | |
|---|---|---|---|
| 4,390,047 | A | 6/1983 | Kaneko |
| 4,494,673 | A | 1/1985 | Hiraishi |
| 4,548,242 | A | 10/1985 | Paradis |
| 4,718,460 | A | 1/1988 | Sato |
| 4,793,385 | A | 12/1988 | Dyer et al. |
| 4,908,911 | A | 3/1990 | Bretti et al. |
| 4,934,416 | A | 6/1990 | Tonkiss |
| 4,947,901 | A | 8/1990 | Rancour et al. |
| 4,993,669 | A | 2/1991 | Dyer |
| 4,997,011 | A | 3/1991 | Dyer et al. |
| 5,031,790 | A | 7/1991 | Keller |
| 5,048,575 | A | 9/1991 | Smith |
| 5,102,075 | A | 4/1992 | Dyer |
| 5,111,003 | A | 5/1992 | Kimbara |
| 5,183,173 | A | 2/1993 | Heckman |
| 5,205,328 | A | 4/1993 | Johnson et al. |
| 5,230,129 | A | 7/1993 | Scruggs |
| 5,417,254 | A | 5/1995 | Kurmis |
| 5,449,086 | A | 9/1995 | Harris |
| 5,492,156 | A | 2/1996 | Dyer et al. |
| 5,595,220 | A | 1/1997 | Leban et al. |
| 5,628,348 | A | 5/1997 | Scott et al. |
| 5,638,975 | A | 6/1997 | Harris |
| 5,647,407 | A | 7/1997 | Scott et al. |
| 5,720,328 | A | 2/1998 | Ott |
| 5,769,133 | A | 6/1998 | Dyer et al. |
| 5,820,083 | A | 10/1998 | Geiger |
| 5,832,964 | A | 11/1998 | Joshi |
| 5,843,964 | A | 12/1998 | Boss |
| 5,845,681 | A | 12/1998 | Kurmis |
| 5,853,524 | A | 12/1998 | Nix |
| 5,909,751 | A | 6/1999 | Teagno |
| 5,915,425 | A | 6/1999 | Nilsson et al. |
| 5,921,290 | A | 7/1999 | Dyer et al. |
| 5,944,063 | A | 8/1999 | Kurmis |
| 5,966,781 | A | 10/1999 | Geiger |
| 6,035,906 | A | 3/2000 | Ott |
| 6,079,582 | A | 6/2000 | Nicke et al. |
| 6,173,855 | B1 | 1/2001 | Stark |
| 6,179,148 | B1 | 1/2001 | Harris |
| 6,202,706 | B1 | 3/2001 | Leban |
| 6,202,879 | B1 | 3/2001 | Gericke |
| 6,206,053 | B1 | 3/2001 | Hillegonds |
| 6,240,602 | B1 | 6/2001 | Geiger |
| 6,279,620 | B1 | 8/2001 | Eason et al. |
| 6,302,157 | B1 | 10/2001 | Deschenes et al. |
| 6,308,852 | B1 | 10/2001 | Hagano |
| 6,325,233 | B1 | 12/2001 | Harris |
| 6,332,553 | B1 | 12/2001 | Yamada et al. |
| 6,457,492 | B1 | 10/2002 | Kuhn et al. |
| 6,497,258 | B1 | 12/2002 | Flannery et al. |
| 6,513,555 | B1 | 2/2003 | Lesser et al. |
| 6,568,553 | B2 | 5/2003 | Hagano et al. |
| 6,745,914 | B2 | 6/2004 | Hagano et al. |
| 6,763,966 | B2 | 7/2004 | Harris |
| 6,793,091 | B2 | 9/2004 | Hagano et al. |
| 6,814,251 | B2 | 11/2004 | Hagano |
| 6,840,289 | B2 | 1/2005 | Hillegonds |
| 6,902,079 | B2 | 6/2005 | Hagano |
| 6,913,162 | B2 | 7/2005 | Hagano et al. |
| 6,997,339 | B2 | 2/2006 | Ueki |
| 7,025,222 | B2 | 4/2006 | Hagano et al. |
| 7,048,138 | B2 | 5/2006 | Hagano et al. |
| 7,086,426 | B2 | 8/2006 | Magno, Jr. |
| 7,124,787 | B2 | 10/2006 | Lueschen |
| 7,185,680 | B2 | 3/2007 | Magno, Jr. |
| D541,142 | S | 4/2007 | Geiger |
| 7,216,679 | B2 | 5/2007 | Magno, Jr. et al. |
| D543,811 | S | 6/2007 | Lueschen |
| 7,231,944 | B2 | 6/2007 | Magno, Jr. et al. |
| D547,626 | S | 7/2007 | Lueschen |
| 7,290,673 | B2 | 11/2007 | Hagano |
| 7,299,830 | B2 | 11/2007 | Levin et al. |
| 7,344,042 | B2 | 3/2008 | Hagano |
| D570,673 | S | 6/2008 | Geiger et al. |
| 7,422,037 | B2 | 9/2008 | Levin et al. |
| 7,437,804 | B1 | 10/2008 | Geiger et al. |
| 7,484,636 | B2 | 2/2009 | Yoshida et al. |
| 7,487,879 | B2 | 2/2009 | Yoshida et al. |
| 7,493,925 | B2 | 2/2009 | Bae |
| 7,520,401 | B2 | 4/2009 | Scharrer |
| 7,588,159 | B2 | 9/2009 | Otsuka |
| 7,591,451 | B2 | 9/2009 | Dyer et al. |
| 7,748,415 | B2 | 7/2010 | Barlosov et al. |
| 7,753,321 | B2 | 7/2010 | Geiger |
| 7,774,905 | B2 | 8/2010 | Geiger |
| 7,784,634 | B2 | 8/2010 | Yoshida |
| 8,051,881 | B2 | 11/2011 | Segroves |
| 8,074,334 | B2 | 12/2011 | Tharp |
| 2004/0262312 | A1 | 12/2004 | Hagano |
| 2007/0045322 | A1 | 3/2007 | Hagano |
| 2009/0223959 | A1 | 9/2009 | Schulz |
| 2010/0089919 | A1 | 4/2010 | Dunkle |

FOREIGN PATENT DOCUMENTS

| | | |
|---|---|---|
| EP | 839717 | 5/1998 |
| EP | 1108649 | 6/2001 |
| FI | 25152 | 5/2012 |
| GB | 1577957 | 10/1980 |
| NO | 83385 | 2/2012 |
| PL | RP-18518 | 4/2012 |
| SE | 82008 | 8/2012 |
| SG | 2011/1547 C | 12/2011 |

OTHER PUBLICATIONS

USPTO Office Action dated Sep. 12, 2014 regarding U.S. Appl. No. 13/534,791, 10 pages.

USPTO Office Action dated Sep. 16, 2014 regarding U.S. Appl. No. 13/534,826, 8 pages.

USPTO Office Action dated Sep. 12, 2014 regarding U.S. Appl. No. 13/534,902, 10 pages.

CABLE TIE TENSIONING AND CUT-OFF TOOL

RELATED APPLICATIONS

This application claims the benefit of U.S. Provisional Patent Application Ser. No. 61/503,403 entitled "Cable Tie Tensioning and Cut-Off Tool and Method of Using", filed 30 Jun. 2011.

BACKGROUND OF THE INVENTION

The present invention relates to hand held tensioning and cutting tools, and particularly to an improved hand tool for tensioning and cutting cable ties.

Cable ties are widely used in a variety of environments and applications. They may be used, for example, to bundle a plurality of elongate wires, cables, or other elongate articles. Cable ties may also be used to secure elongate articles to rigid structures or used as hose clamps, by way of example. Such cable ties typically include an elongate tail portion which is threaded through an integral head portion to encircle the articles to be bound and the tie tail is drawn through the cable tie head to tightly bind the elongate articles into a bundle. After the tie is tensioned around the bundle, the excess length of the tie tail which extends out of the head portion is then severed by the tool close to the head. Ties are often applied in high volumes and to precise tensions.

One disadvantage of many presently available tie tensioning and severing tools is that those tools require an operator to apply an excessive force on their triggers which leads tool operator fatigue after only a relatively small number of cables ties have been installed by the operator. Additionally, many prior art tie tensioning and severing tools have their tool triggers mechanically linked to the tensioning and severing mechanisms in a manner that the actual tension attained in the cable tie immediately prior to severing of the cable tie tail varies with the position of the operator's grip on the trigger during operation of the tool. Tools which rely upon mechanical linkages often increase the tension in the cable tie above the preselected value immediately prior to severing due to the movement of the linkages during the tensioning operation. This can cause stretching, weakening or breakage of the tie during severing.

SUMMARY OF THE INVENTION

The present invention is directed to a hand-held tensioning and severing tool which avoids the aforementioned shortcomings.

In accordance with an important aspect of the present invention, an improved hand-held tie tool is provided which includes reciprocating means for tensioning the cable tie tail, means for locking the tensioning means once a predetermined tension is met, and means for severing the cable tie tail from the cable tie while the tension is locked.

In accordance with another principal aspect of the present invention selective tension adjustment system is provided in the form of an acme thread cam and knob for selectively changing the preselected tie tension to a selected tension value.

Accordingly, it is a general object of the present invention to provide a new and improved hand held tie tensioning and severing tool capable of reliable operation which consistently severs the cable tie tail at substantially uniform tension levels and greatly reduces recoil impact from the system. The tool may further sever the cable tie tails of successively tensioned cable ties consistently at uniform tension levels, irrespective of user generated tool trigger force.

Another object of the present invention is to provide a hand tool for tensioning and severing cable ties which includes rotatable selective tension adjustment means for rapidly and reliably selecting a number of preselected tension levels. Further, the cutoff cam system of the present invention provides enhanced cutoff performance and durability with the tension cut off range being increased to approximately 20-200N.

Still another object of the present invention is to provide a hand-held tool having improved ergonomics at user/tool interfaces to thereby reduce musculoskeletal injury to the user and improve work environment safety.

Yet another object is to provide an improved blade nosepiece interface whereby error in blade installation by the user is greatly reduced.

These and other objects, features and advantages of the present invention will be clearly understood through a consideration of the following detailed description.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention.

Figure 1:
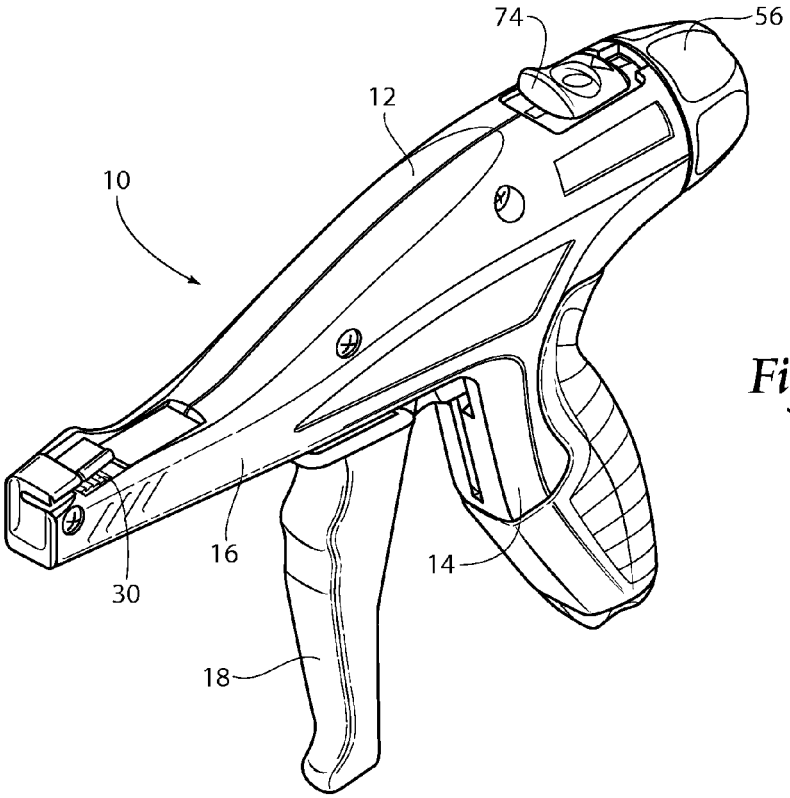
FIG. 1 is a perspective view of a cable tie tensioning and cut-off tool according to the present invention.
Figure 2:
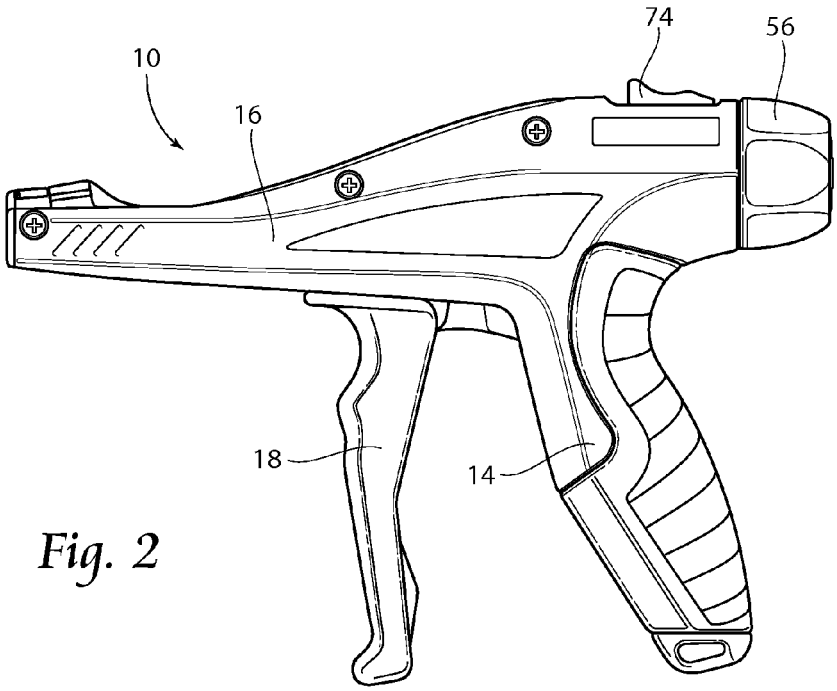
FIG. 2 is a left side view of the tool illustrated in FIG. 1.
Figure 3:
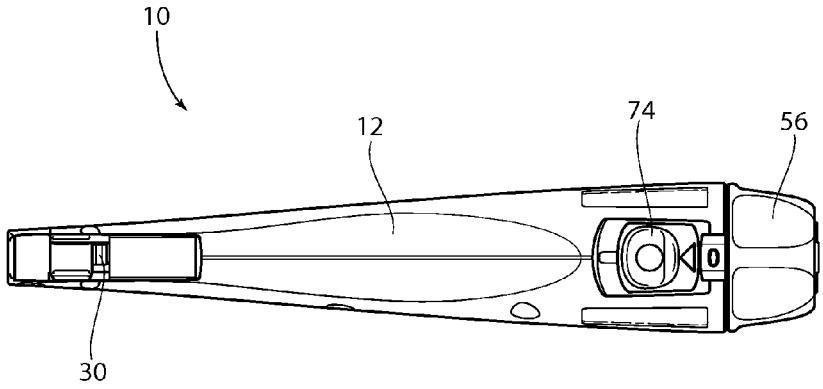
FIG. 3 is a top view of the tool illustrated in FIGS. 1 and 2.

Referring now to the drawings and in particular to FIGS. 1 and 2, an embodiment of the cable tie tensioning and cut-off tool 10 incorporating the principles of the present invention is shown as having a housing 12 in the shape of a pistol or gun and having a handle or grip portion 14, a barrel portion 16, and a trigger 18. The trigger 18 is located forwardly of the grip 14 and under the barrel portion 16 where it fits naturally in the hand of a user (not shown). The tool 10 is typically used to install cable ties 20 (seen in phantom in FIGS. 4A-4D) around elongate bundles 22, such as wire cable or the like. As mentioned earlier, cable ties are widely used in a variety of environments and applications, and may be used, for example, to bundle a plurality of elongate wires, cables, or other elongate articles 22, as shown in the Figures. However, it is to be understood that the tool 10 of the present invention may be used to secure cable ties 20 in other applications, such as to secure elongate articles to rigid structures or used as hose clamps (not shown), by way of non-limiting example. As illustrated, a tie 20 includes a head portion 24 and a tie tail portion 26. The tool 10 grips the tail portion 26 of the tie 20 and pulls it through the head 24 until a predetermined tension is achieved. The tool 10 then locks the tension and automatically cuts off the excess tail portion 26 adjacent the head 24.

As seen in FIGS. 4A-4D, one housing 12 sidewall has been cut away to show the opposite housing 12 sidewall and the internal parts and mechanism of the present tool 10. The tool 10 generally contains a reciprocating tension mechanism, such as the pawl link 28 shown, located in the barrel portion 16 of the tool 10. The tension mechanism 28 further includes a gripping mechanism, such as the tie-gripping pawl 30 shown, for gripping the tail portion 26 of a tie 20, and a locking mechanism, such as the rack 32 and pinion 34 shown for locking the tension mechanism 28 at a predetermined tension prior to activating a cutoff mechanism. In operation, the tensioning mechanism pulls the gripped tail portion 26 rearwardly to a predetermined tension. Upon reaching the predetermined tension, the locking mechanism locks the tension. A cutoff mechanism, such as the illustrated cutter link 118, also located at the forward end of the barrel portion 16, then activates to cause a blade member 160 to cut off the tie tail 26 closely adjacent the head portion 24. The predetermined tension is set or adjusted by way of a tension adjustment mechanism located at the rear of the tool 10, as will be discussed in detail.

The present device provides consistent tension and cutting performance such that uniform tension per setting across all tools is achieved. The device target goal is no scatter in tension force per setting. Present devices have tolerances of up to +/−25N. Tolerance range is greatly reduced with the present device.

Tension Adjustment System

The present tool 10 includes a novel tension adjustment mechanism. As will be seen, the tension control and adjustment mechanism of the present tool 10 functions to provide a controlled tension to the rear of the cutoff cam 36 (see FIGS. 4A-4C). This, in turn, determines the point at which the cutoff cam 36 pivots to actuate the locking mechanism and the cutoff mechanism, to thereby cutoff the tie tail 26.

The tension adjustment system of the present device is simple to use and eliminates the use of two knobs, as in known devices, through the use of an acme thread cam action and knob as will be discussed. With reference particularly to the view of FIGS. 5-7C, it may be seen that the tension control mechanism includes a U-bracket 38 positioned horizontally, and slidably moveable, within the housing 12 at the rear end of the barrel portion 16. The forward ends 40 of the U-bracket 38 are pivotally coupled to the rear end of the cutoff cam 36 by means of a tension pin 42 extending through the forward ends 40 of the U-bracket and through an elongated slot 44 formed in the cutoff cam 36 (see particularly FIG. 10B). The rearward end of the U-bracket 38 is biased toward the rear of the housing 12 by means of the inner and outer tension springs, 46, 48 respectively. The tension springs 46, 48 are confined between a tension shaft 50 and a tension nut 52. A rotating cam 54 is coupled to a tension adjustment knob 56 by way of tessellated portions 58 which engage corresponding interlocking splines 60 in the adjustment knob 56. The rotating cam 54 further includes a threaded portion 62 adapted to threadingly engage fixed cam 64 and its housing 66. As the adjustment knob 56 is turned, the rotating cam 54 either draws the tension shaft 50 closer to the rear of the housing 12 or drives the tension shaft 50 farther from the rear of the housing 12 depending on the direction in which the adjustment knob 56 is turned. Accordingly, the tension applied by the U-bracket 38 to the cutoff cam 36 is increased as the adjustment knob 56 is turned so as to compress the tension springs 46, 48 and is decreased as the adjustment knob 56 is turned to decompress the tension springs 46, 48.

Figure 7A:
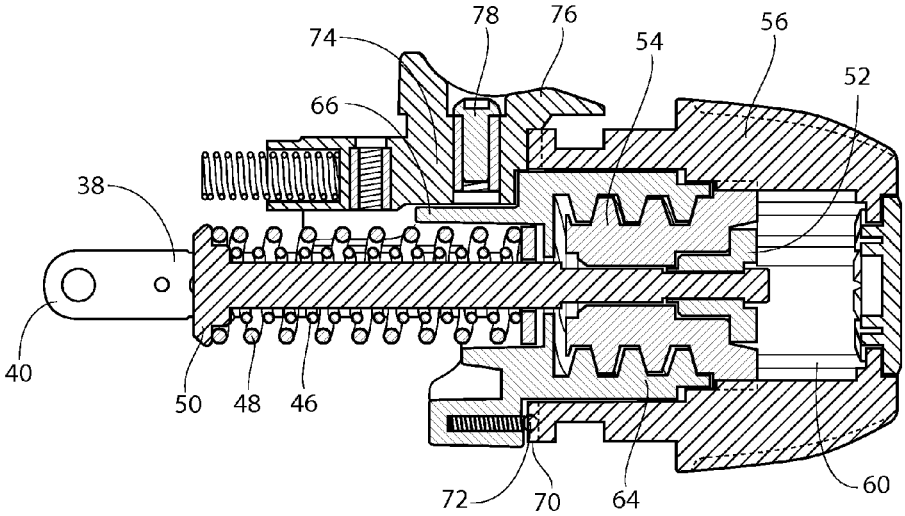
FIGS. 7A-7C are cross sections of the control knob illustrated in FIG. 5 and taken along lines 7A thereof showing further details of the form and function of the control knob and operation of the control knob.
Figure 7B:
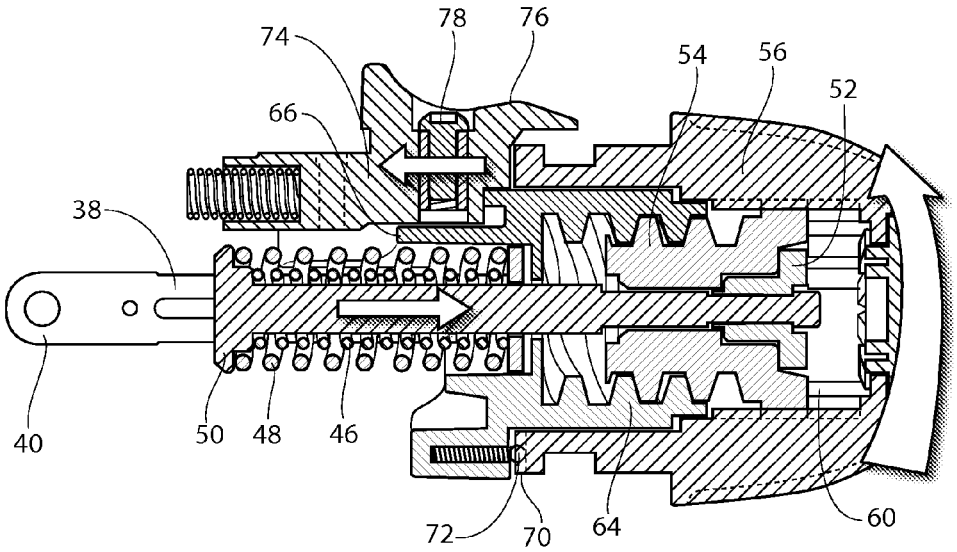
Figure 7C:
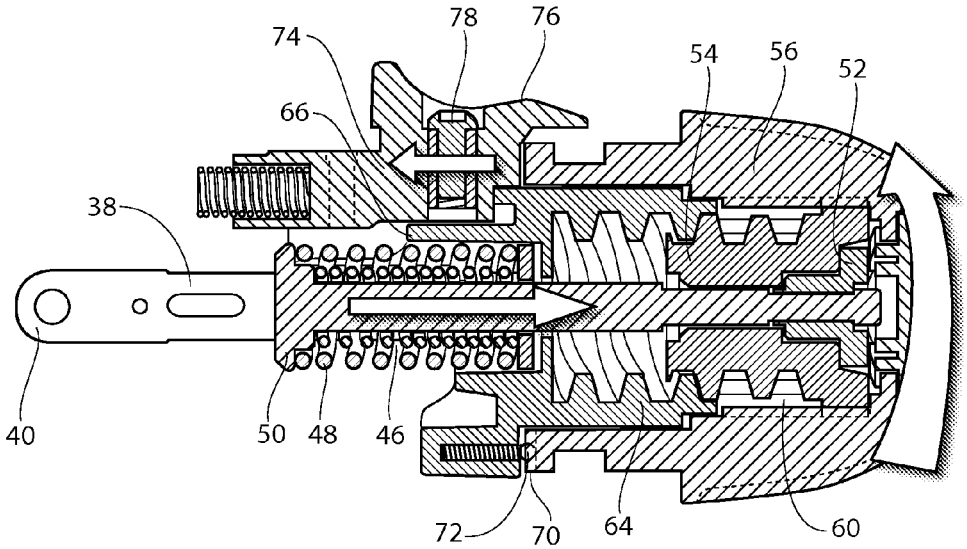
Figure 8A:
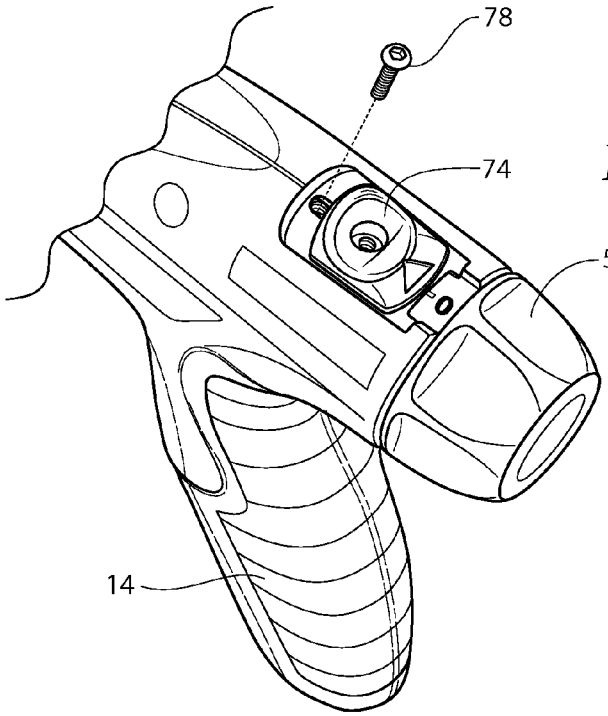
FIGS. 8A and 8B are, respectively, fragmentary, partially exploded and fragmentary views of a locking mechanism on the tool shown in FIGS. 1-4D.
Figure 8B:
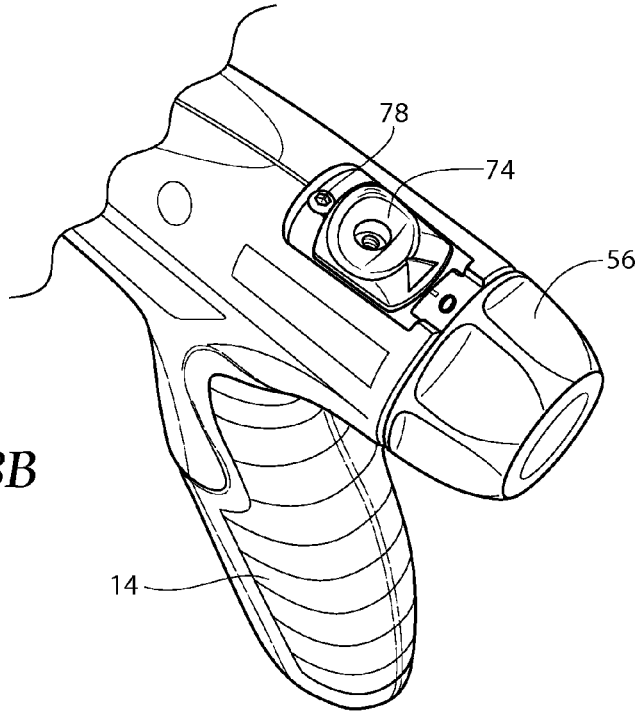

As seen in FIG. 7A, the tessellated portions 58 of rotating cam 54 mate with and slide on splines 60. This features allows the threaded portion 62 to rotate and move longitudinally along the splines, while the adjustment knob 56 remains stationary. This feature allows the overall tool 10 length and overall ergonomics to remain constant throughout its adjustment range.

Preferably, the adjustment knob 56 includes indicia 68 to designate selected tension settings. The indicia 68 may correspond to the incremental tension ranges provided by detents 70 on the adjustment knob 56 in which a ball 72, or other suitable device, rides. The present tension adjustment system further includes capability to calibrate, hold and lock. A locking latch 74 is slidingly located on the housing 66 of the fixed cam 64. As seen particularly in the view of FIGS. 6-8B, the locking latch 74 includes a switch 76 and a locking pin 78, seen as a screw in these views. To adjust tension, the hold switch 76 on the top of the tool 10 is moved to an unlocked position; the adjustment knob 56 is rotated to the desired tension setting; the hold switch 76 is released to the lock position. The precise tension setting is accomplished by rotating the adjustment knob 56 across multiple discrete detent stops 70. The tension adjustment system preferably includes the Mil Spec 1 through 8 settings, including and ½ and ¼ increments. Further, the tension adjustment system may be calibrated at the point of manufacture or may be calibrated in the field. When the device 10 is to be calibrated in the field, a calibration tension tool 80, may be used, as will be discussed later with reference to FIGS. 16A-17B.

Tension-Lock-Cut System

The tension-lock-cut system embodying various features of the invention, and its operation, may be seen in FIGS. 9-12. The tension-lock-cut system of the present invention reduces the tool 10 backlash perceived by a user, eliminates dynamic tension on the cable tie 20 during the tension and cut phases, and standardizes cut-off force during the cut phase. To these ends, the tension-lock-cut system includes a tension-lock-cut linkage 82 (see FIGS. 10A and 10B).

Linkage

As seen, the linkage 82 includes a pawl link 28 mounted for horizontal, linear reciprocal movement relative to the housing 12. The pawl link 28 is supported for linear movement within the housing 12 by way of channels (not shown) formed in the interior wall the housing 12. A tie gripping pawl 30 is carried at the forwardmost end 84 of the pawl link 28 (see FIG. 10) and is pivotally attached to the pawl link 28. The gripping pawl 30 is upwardly pivotable, as will be discussed later in greater detail.

Figure 10:
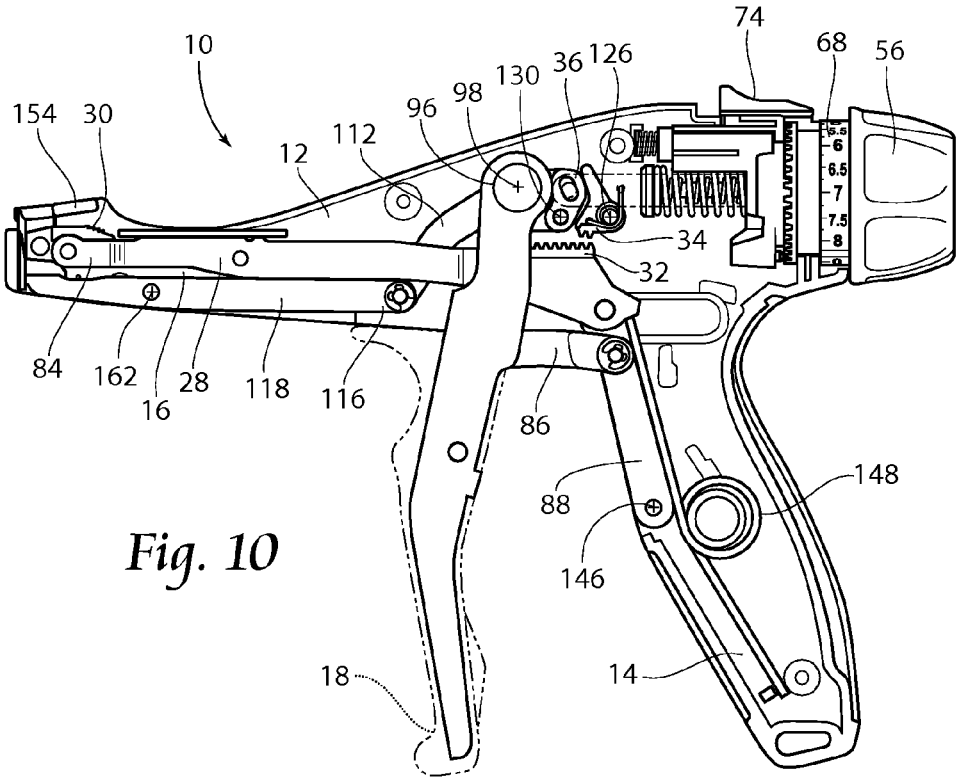
FIG. 10 is a left side view of the tool with a portion of the housing removed.
Figure 10A:
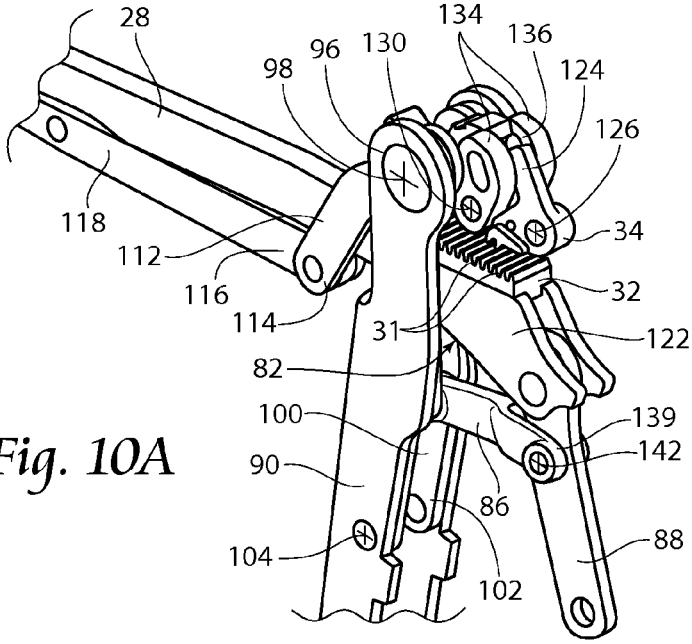
FIGS. 10A and 10B are, respectively, fragmentary perspective and exploded views of a linkage on the tool shown in FIGS. 1-4D.
Figure 10B:
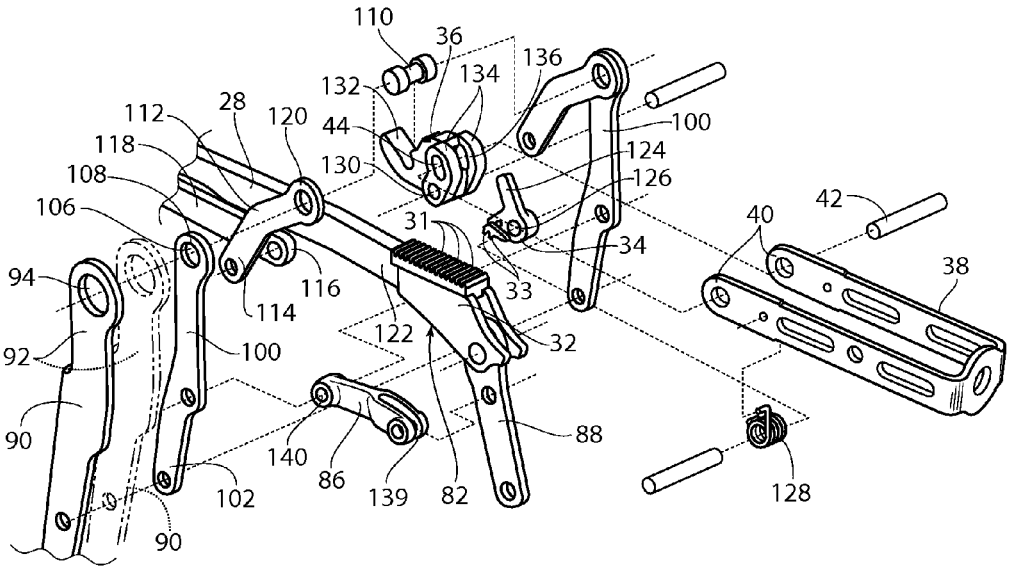

Referring further to FIGS. 10A and 10B, the pawl link 28 is reciprocated within the housing 12 by way of an actuating structure located in the trigger 18, a short link 86, and a handle link 88. The trigger 18 includes an elongate, rigid trigger handle link 90 that extends upwardly into the barrel portion 16 of the housing 12. As seen, the trigger handle link 90 includes two substantially parallel spaced arms 92 at its upper end. Each of the arms 92 includes an aperture 94. A pair of trigger bearings 96 dimensioned to be closely received in the apertures 94 serves to pivotally mount the trigger handle link 90 within the housing 12 for movement around a substantially horizontal pivot axis 98. When thus mounted, the trigger 18 is movable from a forward or initial position shown in FIG. 11A, to a rearward or final position adjacent the handle 14, as shown in FIG. 11D.

A pair of trigger inner links 100 extends upwardly into the barrel portion 16 of the housing 12 alongside the trigger handle link 90 between the arms 92. The lower ends 102 of the trigger inner links 100 are pivotally joined to the trigger handle link 90 for pivoting movement around a substantially horizontal pivot axis 104. The upper ends 106 of the trigger inner links 100 further include apertures 108. The upper ends 106 support a horizontally disposed dog bone cam shaft 110 that is concentrically aligned with the apertures 94 in the upper ends of the trigger handle link 90 and apertures 108 in the inner trigger links 100. Intermediate links 112 each comprise rigid, elongate, substantially parallel member that are of arcuate form. The intermediate links 112 are each pivotally joined at their lower ends 114 at a rearward point 116 of the cutter link 118. The intermediate links 112 are further pivotally joined at their upper ends 120 to the upper ends 106 of the trigger inner links 100 by way of dog bone cam shaft 110.

A rack member 32 having a plurality of upstanding teeth 31 is affixed to the rearwardmost end 122 of pawl link 28. The rack member 32 is adapted to engagingly support pinion member 34. Pinion member 34 includes a plurality of teeth members 33 adapted to engage the corresponding teeth members 31 in the rack member 32. The pinion member 34 further includes an upstanding arm member 124 and pivot members 126. Pivot members 126 are adapted to support pinion torsion spring 128 (see FIGS. 10B and 11A). The pinion torsion spring 128 pivotally biases the pinion 34 toward the cutoff cam 36, such that the upstanding arm member 124 is in contact with the cutoff cam 36.

The cutoff cam 36 is pivotally mounted for pivotal movement around a substantially horizontal pivot axis 130 and includes a cradle 132 in its upper surface. The dog bone cam shaft 110 ordinarily rests in the cradle 132. The cutoff cam 36 is preferably further formed with a pair of spaced apart blocks 134 which form a channel 136 at a rearward portion of the cutoff cam 36. The channel 136 is adapted to receive the upstanding arm member 124 of pinion 34. It is to be noted that the width of the cradle 132 is preferably of a width great enough to enhance toll longevity and consistent repeatability.

As further shown, the linkage 82 also includes a handle link 88 having an upper end extending upwardly and forwardly toward the rear end 122 of the pawl link 28. A pair of substantially parallel spaced short links 86 is pivotally joined at their forward ends 138 to the trigger inner link 100 at pivot axis 140. The short links 86 are further joined at their rearward ends 130 to the handle link 88 for pivoting movement around substantially horizontal axis 142.

As mentioned previously, the linkage 82 is coupled to the tension adjustment system through the U-bracket 38. Forward ends 40 of the U-bracket 38 are pivotally coupled to the rear end of the cutoff cam 36 by means of a pin 42 extending through the forward ends of the U-bracket 38 and through the elongated slot 44 formed in the cutoff cam 36.

Tension Operation

Figure 11A:
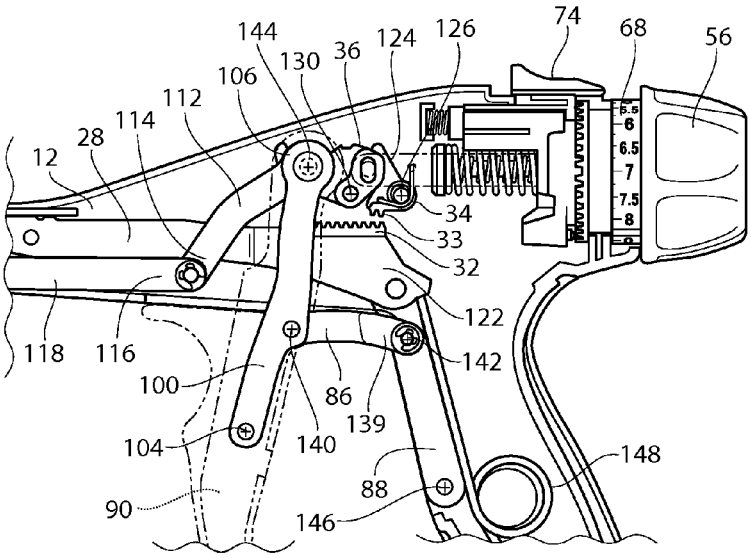
FIGS. 11A-11D are left side, fragmentary, views of a tool according to the present application, but with a portion of the housing removed, and showing the tension-lock-cut linkage system in use with movement of the tool parts shown with arrows.

FIG. 11A shows the linkage in its initial, un-actuated state. In this position, the trigger handle link 90 and trigger inner links 100 are fully forward and away from the handle member 14. The cutoff cam 36 is pivoted in its full clockwise position around the pivot axis 130 under a predetermined tension developed and controlled by the tension adjustment system. This seats the dog bone cam shaft 110 into the cradle 132 and aligns the dog bone cam shaft 110, the upper end 106 of the inner trigger links 100, and the upper ends 120 of the intermediate links 112 with pivot axis 144.

Figure 11B:
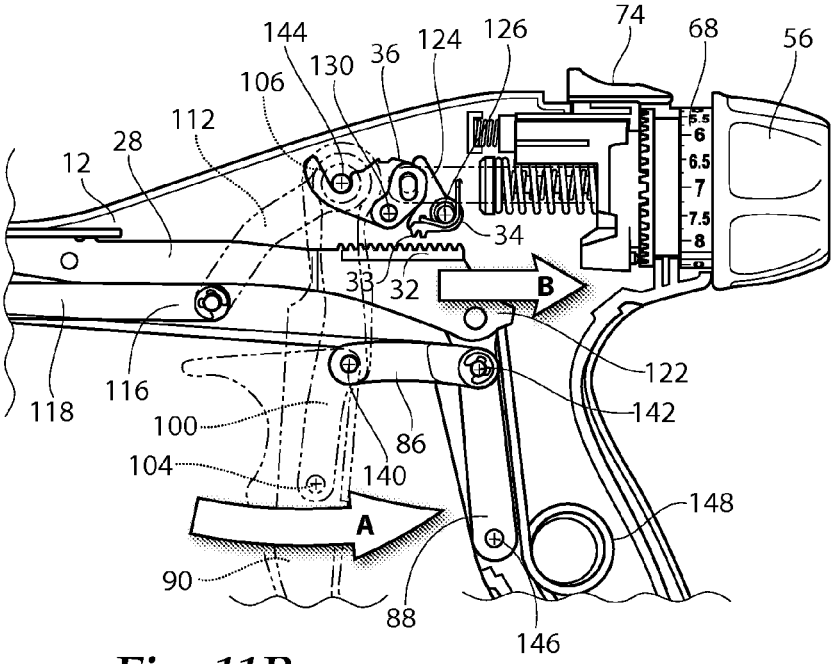
Figure 11C:
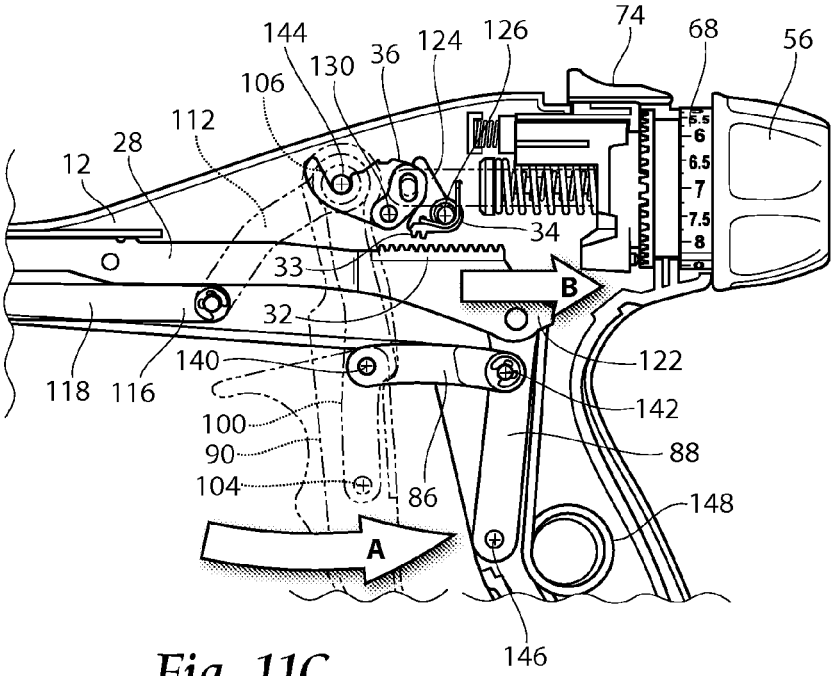
Figure 11D:
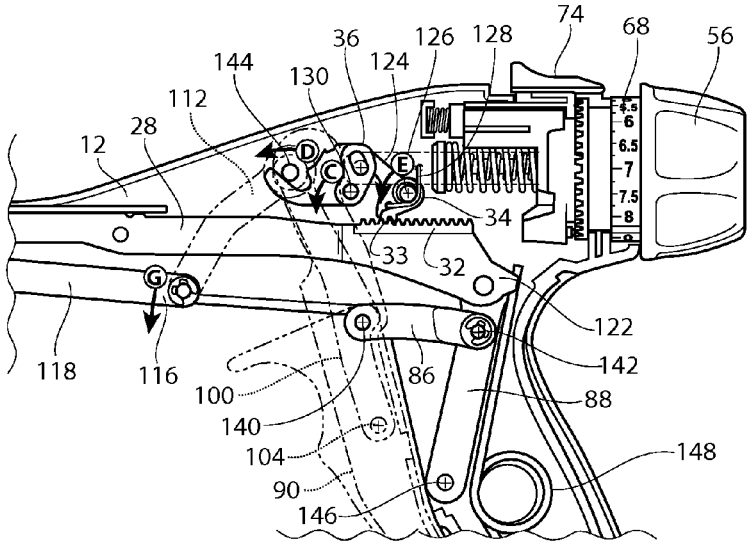

As viewed in FIG. 11B, cable tie tensioning beings when the trigger 18 is squeezed toward the handle or grip portion 14 in the direction of arrow A. As the trigger 18 begins moving, the short link 86 pivots the handle link 88 in a clockwise direction around the pivot axis 146 and against handle torsion spring 148. At the same time, the handle link 88 draws the pawl link 28 away from the nose piece 150 (see FIGS. 4*b* and 4C). As the pawl link 28 begins to move back in the direction of arrow B, the pawl 30 disengages from the nose guide block 152 and begins to pivot upwardly in response to its spring bias, thereby trapping the tie tail 26 between itself and the nosepiece backing plate 154. This grips the tie tail 26 and pulls the tie tail 26 back along with the pawl 30 and pawl link 28. This has the further effect of pulling the tie tail 26 through the head portion 24 to tighten the tie 20 around a bundle 22.

When the tie 20 is initially installed and the tie tail 26 is first pulled back, it generates little resistance to being pulled. As the tie 20 draws up against the bundle 22, the tie tail 26 begins to resist being pulled. The resistance is felt by the pawl link 28 and is transferred through the handle link 88, the short link 86 and inner trigger link 100 to the dog bone cam shaft 110. As long as the tie tail 26 does not resist being pulled by the pawl link 28, little resistance is felt by the handle link 88 as it is pushed back by the short link 86. As the tie tail 26 begins to resist being pulled, the resistance felt by the pawl link 28 is transferred back through the handle link 88, the short link 86, the inner trigger link 100, and to the dog bone cam shaft 110. The resistance force transferred by the short link 86 to the inner trigger link 100 tends to pivot the inner trigger link 100 in a clockwise direction about the pivot axis 140. Such pivoting movement on the inner trigger link 100 is impeded by the dog bone cam shaft 110 that is held in position by the cutoff cam 36.

The resistance force that is transferred to the dog bone cam shaft 110 through inner trigger link 100 tends to rotate the cutoff cam 36 around the cam pivot axis 130. The cutoff cam 36 resists such rotation due to the restraining force applied to it by the tension control mechanism. The force increases as the tie tail 26 is pulled more snugly, until the resistance force becomes great enough to overcome the force applied to the cutoff cam 36 by the tension control mechanism. When this occurs, the cutoff cam 36 rotates in the counterclockwise direction shown by arrow C in FIG. 11D.

Figure 9:
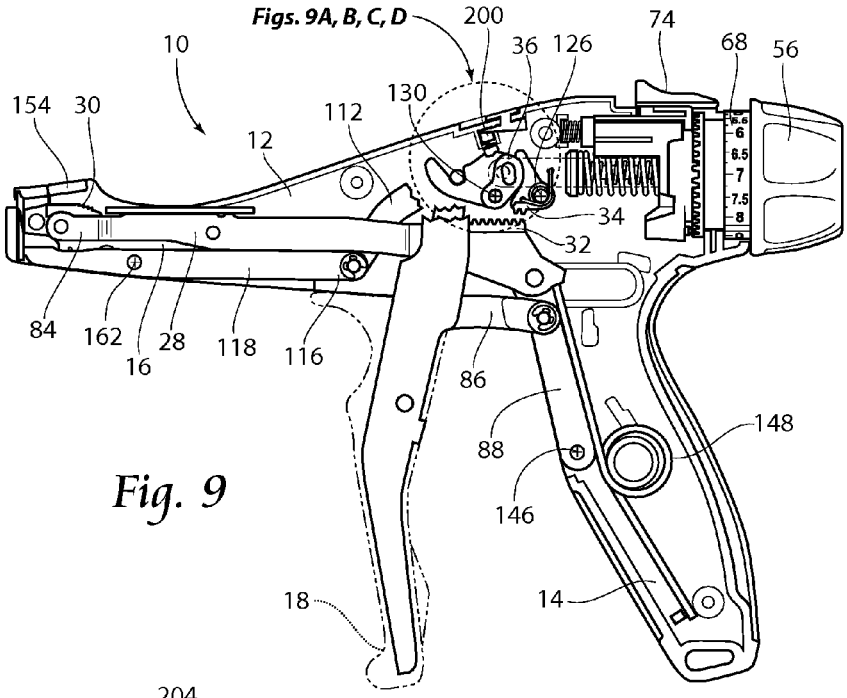
FIG. 9 is a left side view of the tool with a portion of the housing removed and showing an optional low tension feature.
Figure 9A:
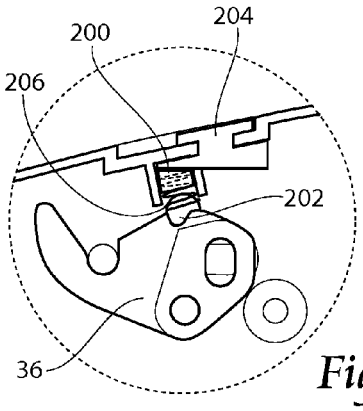
FIGS. 9A-9D are enlarged, fragmentary views of the low tension feature illustrated in FIG. 9 and showing movement of the associated parts.
Figure 9B:
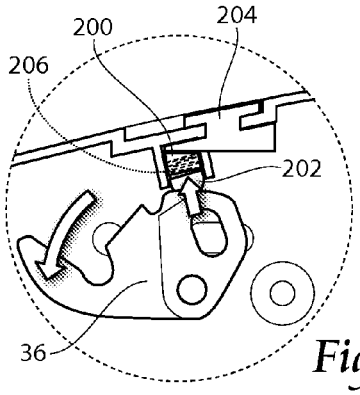
Figure 9C:
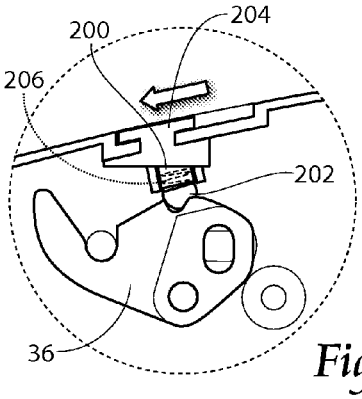
Figure 9D:
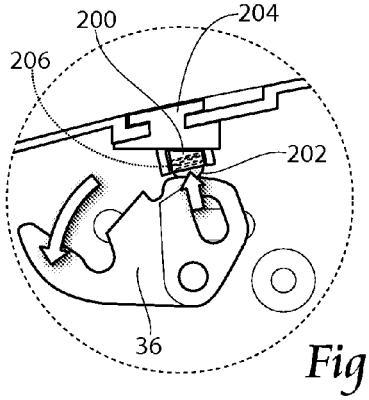

An alternative, low tension arrangement may be seen in the views of FIGS. 9-9D. When the tool 10 is used in low tension operation, the possibility exists that tension is insufficient to disengage the cutoff cam 36. In this context, and as shown, the tool 10 may be provided with a cavity 200, having a spring biased ball bearing 202. When engaged, the ball bearing 202 provides biasing pressure against the cutoff cam 36 to thereby provide the additional tension necessary for proper tool 10 function in low tension applications. As illustrated, a slidable low tension latch 204 may be moved from a first position to a second position to thereby change the degree of compression on the spring 206 and thereby adjust the degree of ball 202 bias against the cutoff cam 36.

Lock Operation

The lock operation may be best viewed in the illustration of FIG. 11D. As seen, operation of the device has progressed to the point at which the resistance force transferred through the pawl link 28, the handle link 88, the short link 86 and inner trigger link 100 to the dog bone cam shaft 110 has become great enough to overcome the force applied to the cutoff cam 36 by the tension control mechanism. As seen, the cutoff cam 36 rotates in the counterclockwise direction shown by arrow C around the cam pivot axis 130, thereby allowing the dog bone cam shaft 110 to move forwardly, in the direction of arrow D, out of the cradle 132 in the cutoff cam 36. When this occurs, the pinion 34 rotates in a counterclockwise direction, shown by arrow E, through the biasing action of pinion torsion spring 128. The pinion 34 continues to rotate in the direction of arrow E until the plurality of pinion teeth members 33 engage corresponding teeth members 31 in the rack 32. The engagement of pinion teeth members 33 and rack teeth members 31 effectively locks further rearward tensioning of the component parts. It will be appreciated that the advantage provided by the locking of rearward tensioning just prior to the cutoff operation causes the tool 10 to accurately tension the tie tail 26 each time a cut is performed. Further, blade 160 life is increased since the tie tail 26 is stationary during cutoff. This eliminates inadvertent drag of the tie tail 26 across the blade 160 sharp edge which occurs when the tie tail 26 is constantly tensioned during cutoff operation.

Cutoff Operation

Figure 4A:
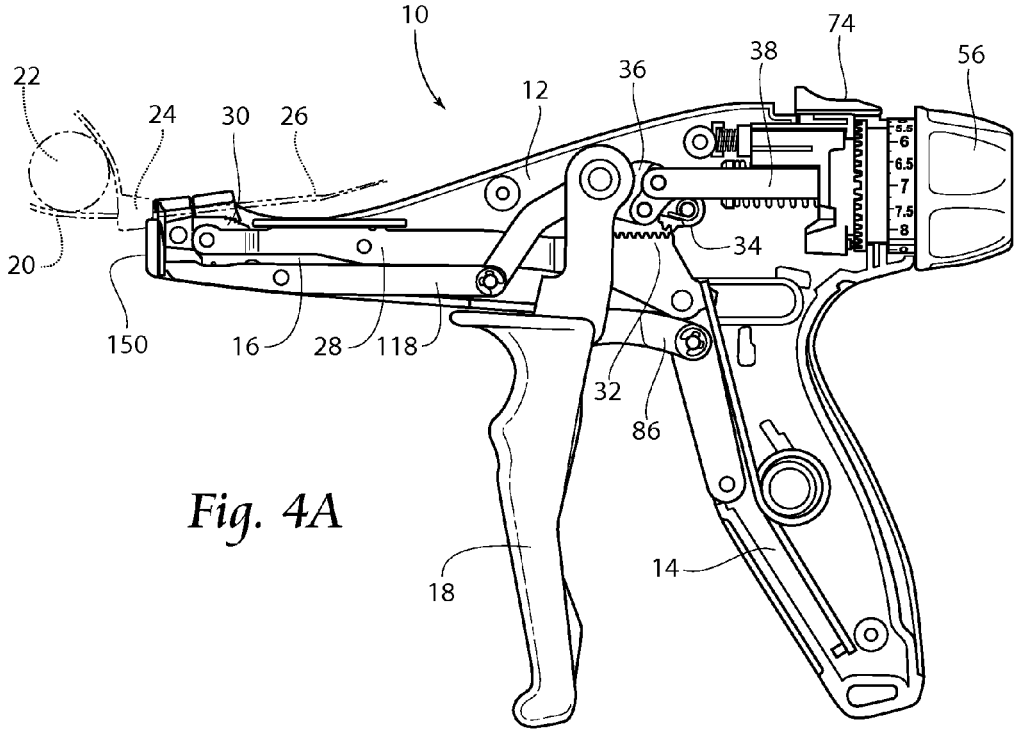
FIG. 4A is a view similar to that of FIG. 2, but with a portion of the housing removed with cable tie and bundle shown in phantom.
Figure 4B:
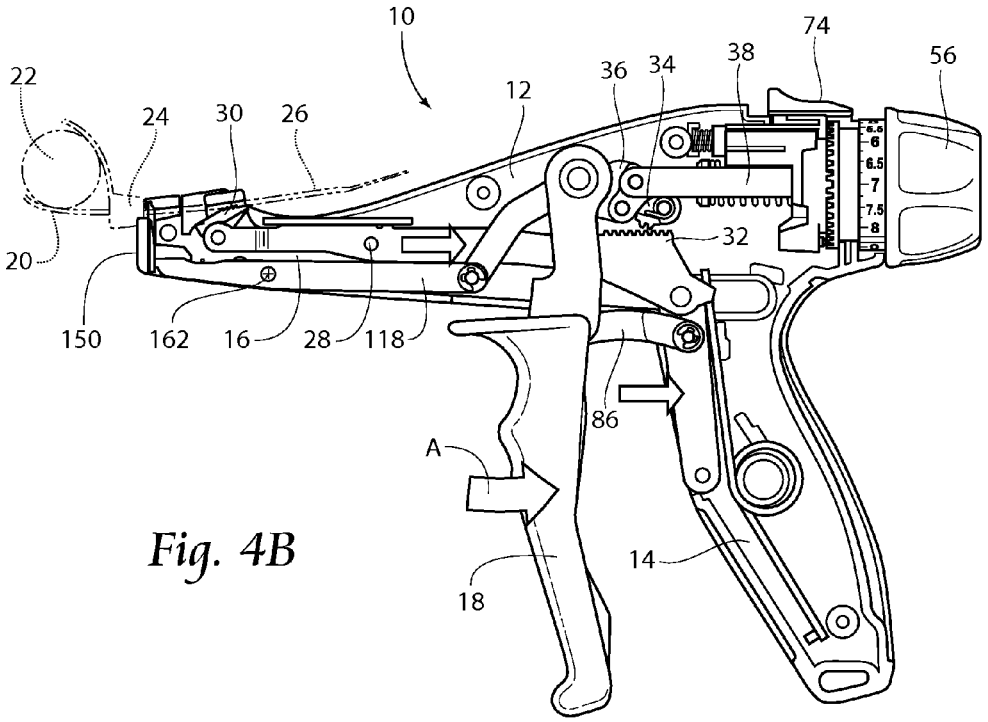
FIG. 4B is a view similar to that of FIG. 4A and showing initiation of the tensioning and cut-off process, with tool parts moving the direction of arrows.
Figure 4C:
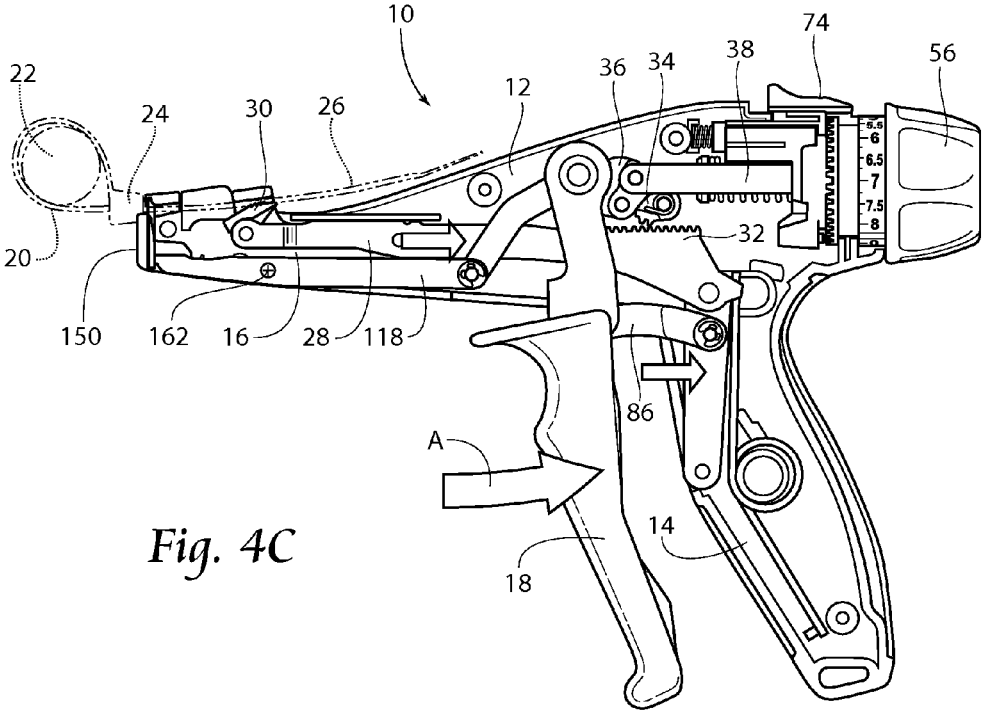
FIG. 4C is a view similar to that of FIG. 4B and showing continuation of the tensioning and cut-off process, with tool parts moving the direction of arrows.
Figure 4D:
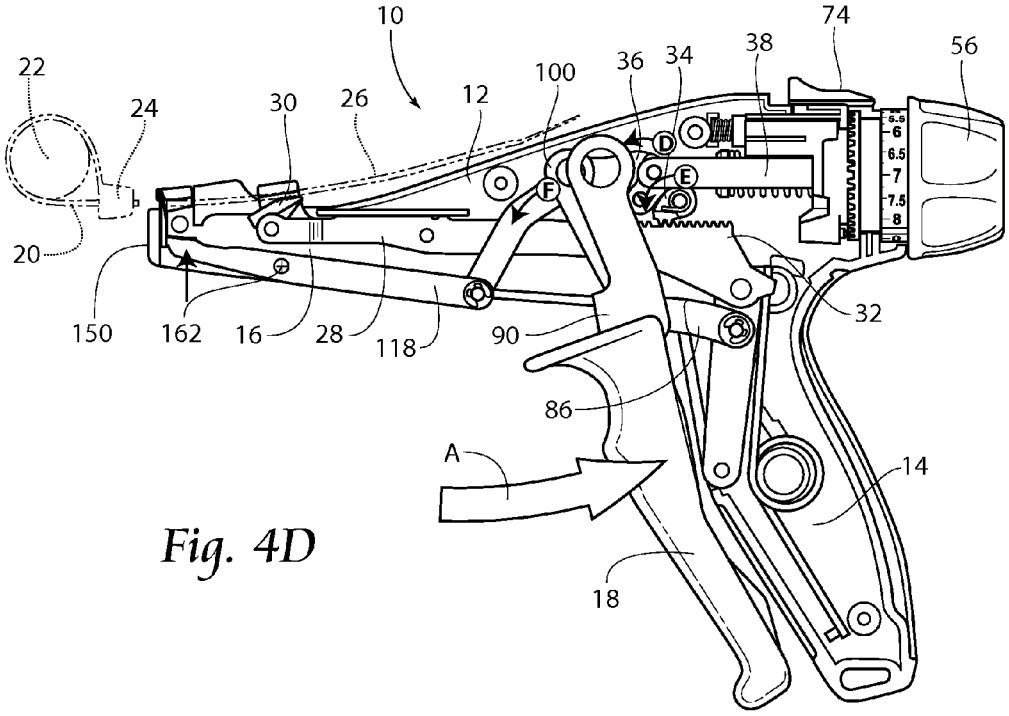
FIG. 4D is a view similar to that of FIGS. 4B and 4C showing conclusion of the tensioning and cut-off process, with tool parts moving the direction of arrows and cable tie tail severed.
Figure 5:
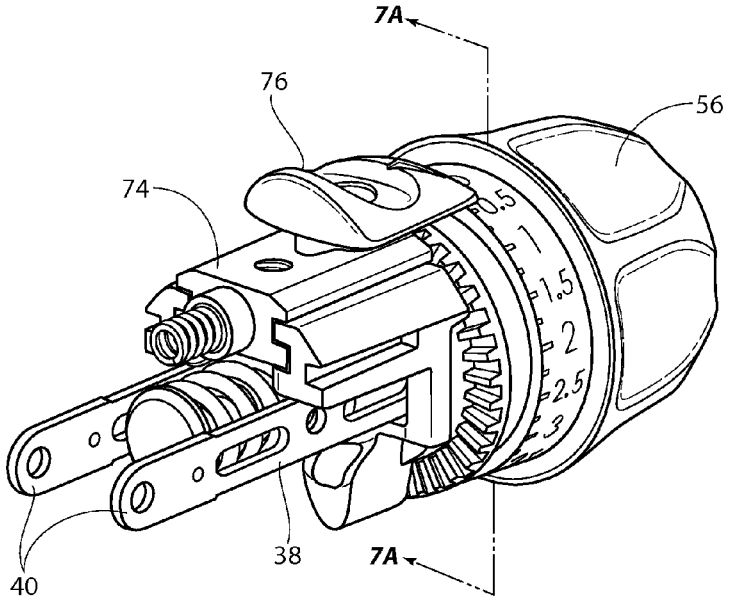
FIG. 5 is a perspective view of a control knob on the tool shown in FIGS. 1-4D that provides tension adjustment.
Figure 6:
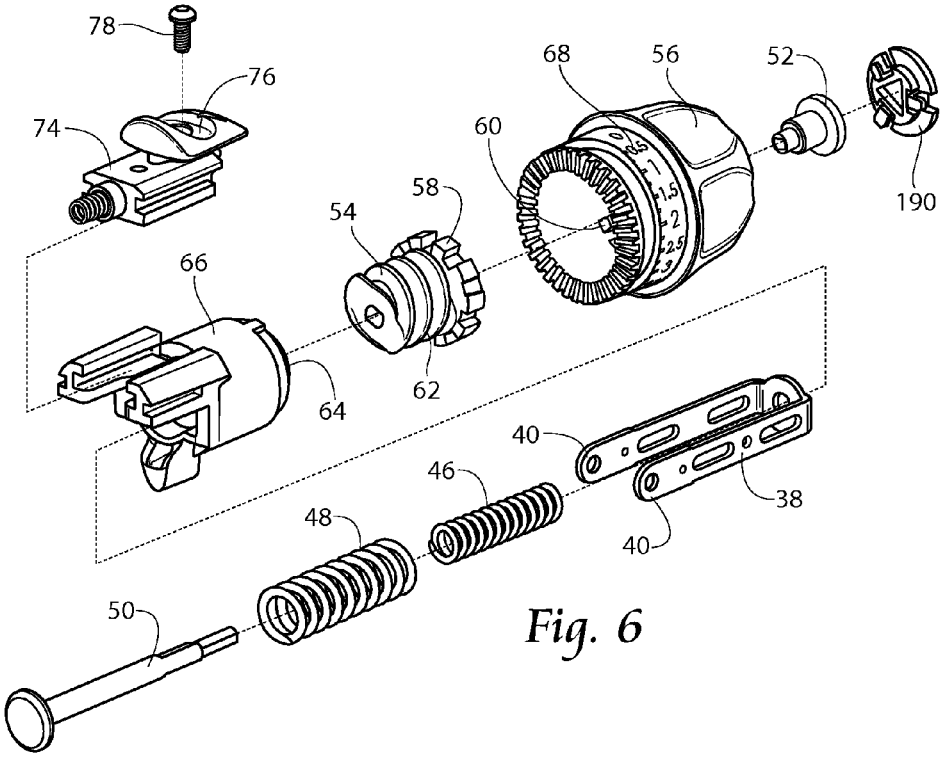
FIG. 6 is an exploded view of the control knob shown in FIG. 5.
Figure 12:
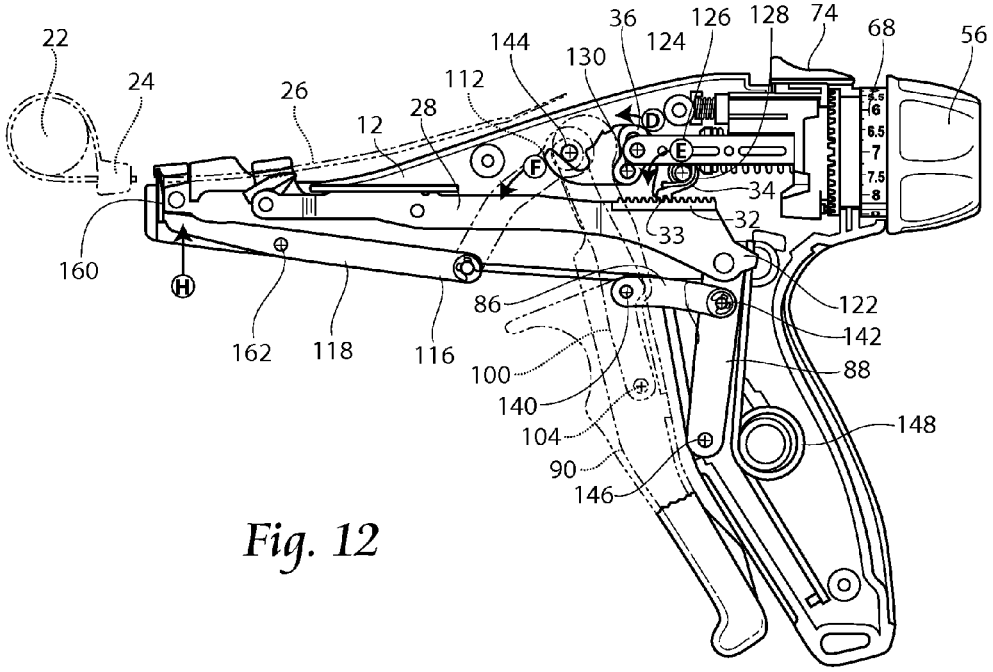
FIG. 12 is a view similar to those of FIGS. 11A-11D, but showing the barrel portion and the cut step of the tension-lock-cut linkage system.

Cutoff of the tie tail 26 and movement of cooperating parts may be viewed in FIGS. 4D and 12. As seen, once the pinion 34 and rack 32 have engaged one another and rearward tensioning ceases, intermediate link 112 moves in the direction of arrow F (see FIG. 12). As it does so, it pushes the rear end 116 of the cutter link 118 down in the direction of arrow G (see FIG. 11D). This movement pivots the cutter link 118 around the cutter link axis 162 thereby causing the cutter link 118 to raise the blade member 160 in the direction of arrow H, and thereby cut off the tie tail 26. When the tie tail 26 is cut, it no longer applies a resisting force to the pawl link 28 and the tool 10 returns to the original condition seen in FIG. 4A.

Ergonomics

The present device 10 is further provided with certain features designed to improve the ergonomics of the device. As may be viewed particularly in FIGS. 13A-14C, the device 10 may include protective coverings, or boots 170, over certain areas of user interface.

Figure 13A:
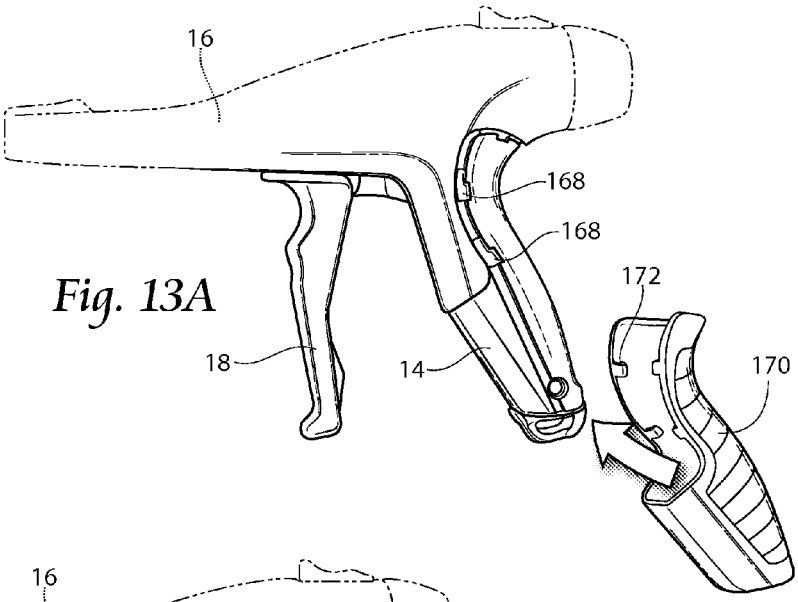
FIG. 13A is a left side, partial phantom, exploded view of a removable handle boot for use with the present tool.
Figure 13B:
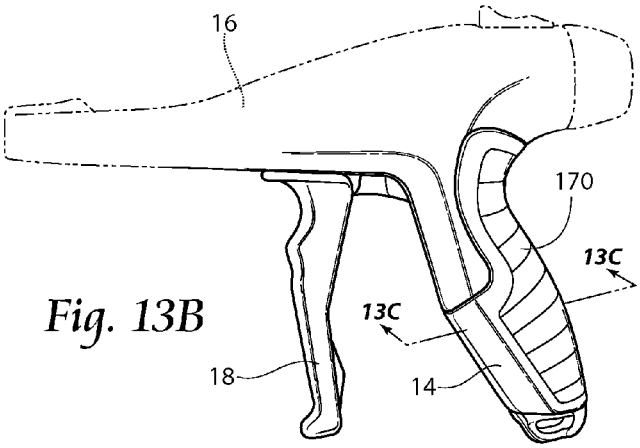
FIG. 13B is a view similar to that of FIG. 13A, but showing the handle boot in place on the tool.
Figure 13C:
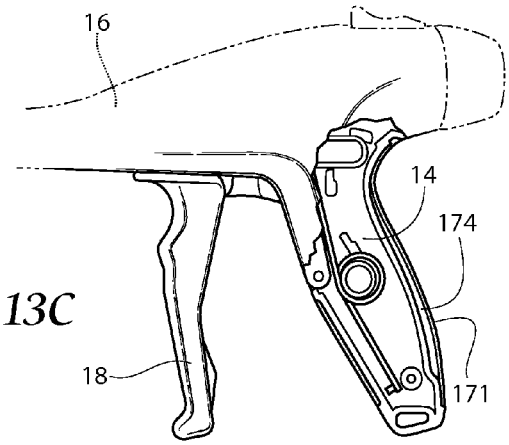
FIG. 13C is a cross sectional view of FIG. 13B and taken along lines 13C-13C thereof, and illustrating the handle air bladder.

With particular reference to FIGS. 13A-13C, it may be seen that the handle portion 14 may include a handle boot 170. The handle boot 170 is preferably fabricated of soft, elastomeric material, such as rubber, or other suitable resilient material that will conform to the user's hand (not shown). The boot 170 may be joined to the handle member 14 by way of a key lock system as is shown, wherein key members 172 are molded as a part of the boot 170, with key members 172 adapted to be engaged in lock apertures 168 in the handle member 14. As may be seen with particular reference to FIG. 13C, while in the installed position, the handle boot 170 and the handle member 14 interact to create a air bladder 174. The air bladder 174, in conjunction with the soft characteristic of the handle boot 170, creates a trampoline effect during use of the tool 10. For example, as the user's hand pushes against the handle boot surface 171, the air bladder 174 and boot 170 conform to the user's hand thereby reducing user fatigue and discomfort.

Figure 14A:
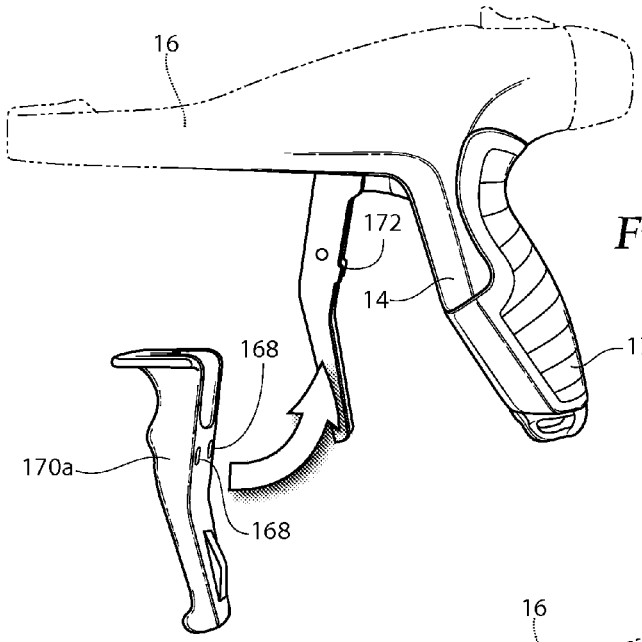
FIG. 14A is a left side, partial phantom, exploded view of a removable trigger boot for use with the present tool.
Figure 14B:
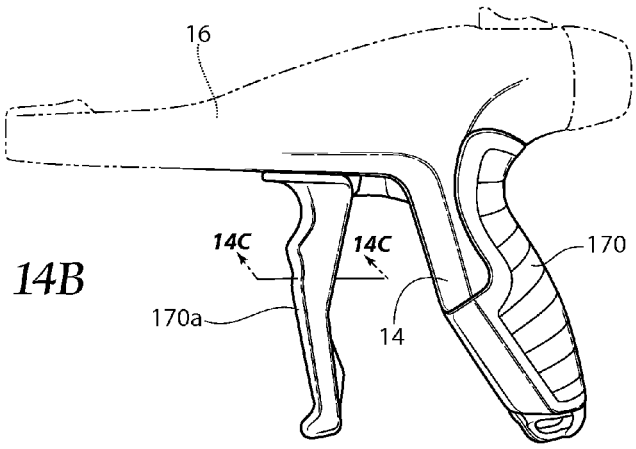
FIG. 14B is a view similar to that of FIG. 14A, but showing the trigger boot in place on the tool.
Figure 14C:
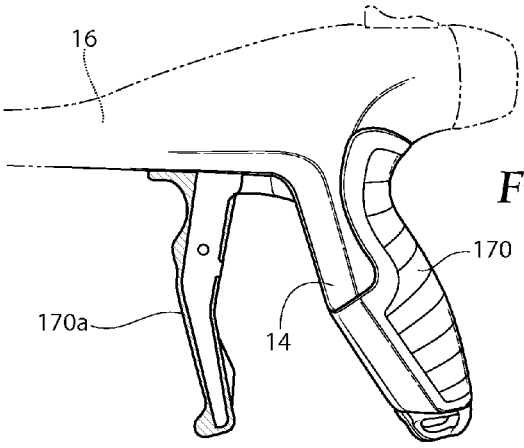
FIG. 14C is a view similar to that of FIG. 14B, but showing the trigger in cross section to illustrate the trigger boot in place.

As may be viewed in FIGS. 14A-14C, the device 10 is seen to further include a trigger boot 170A. Similar to the handle boot 170, the trigger boot 170A is preferably formed of a soft, elastomeric material, such as rubber, or other suitable resilient material that will conform to the user's hand. As in the handle boot 170, the trigger boot 170A may be joined to the trigger member 18 by way of a key lock system. In the case of the trigger boot 170A key members 172 may be formed as a part of the trigger member 18, which are adapted to be engaged in lock apertures 168 formed in the trigger boot 170A.

The overall design and mentioned ergonomic improvements to the tool 10 are known to improve measurable applied grip force, thereby reducing musculoskeletal injury to the user and improving work environment safety. For example, when rated on the Borg-10 rating of perceived exertion scale, users consistently rated the tool 10 as requiring less than "moderate" effort as compared to other prior art tools. (See Borg, G. A., *Psychophysical Bases of Perceived Exertion, Med Sci Sports Exerc.* 1982; 14(5): 377-81 for discussion of the Borg-10 scale). Further, when evaluated using the Strain Index, (see Moore J S, Garg A., *The Strain Index: A Proposed Method to Analyze Jobs for Risk of Distal Upper Extremity Disorders, Am Ind Hyg Assoc J.* 1995 May; 56(5): 443-458), the present tool 10 resulted in more "low risk" scenarios as compared to other prior art tools. The Strain Index is a semi-quantitative evaluation method that considers several exposure variables to determine the risk of user musculoskeletal disorders. Variables include intensity of effort, efforts per minute, percent duration of exertion, among others.

Blade Interface

Figure 15A:
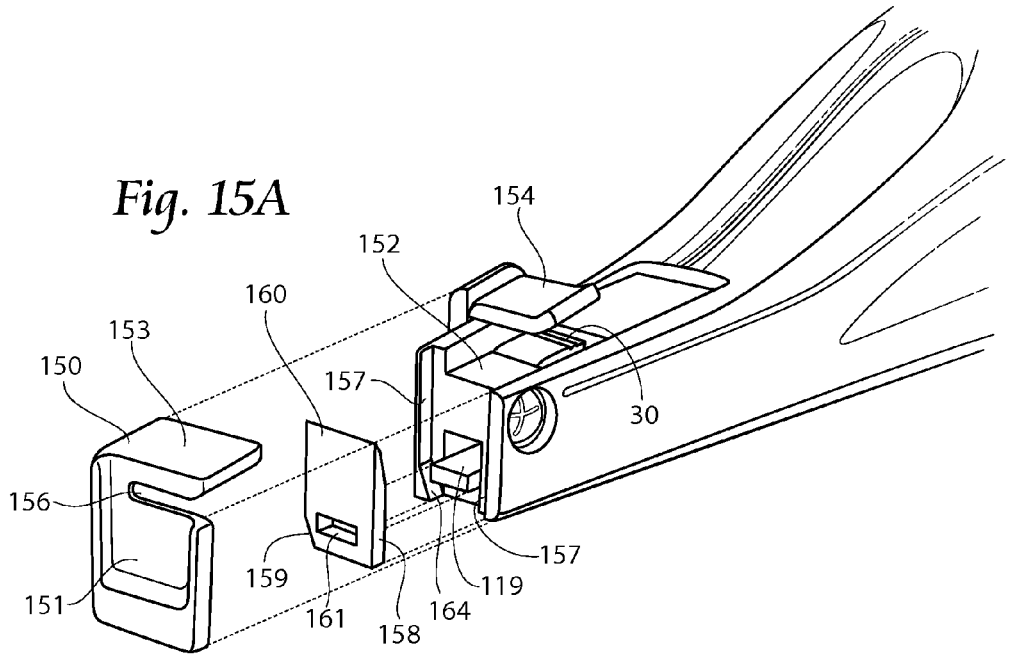
FIG. 15A is a fragmentary, exploded view of the nosepiece and blade member of the present tool.
Figure 15B:
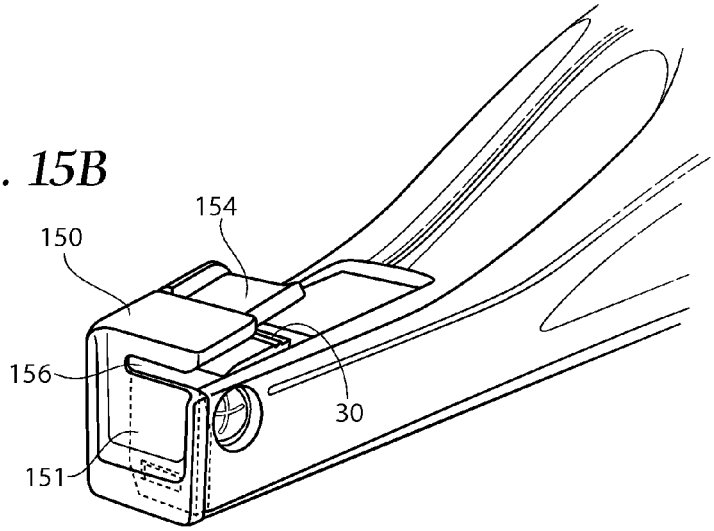
FIG. 15B is a fragmentary view of the nosepiece of the present tool and showing the blade member affixed in phantom.
Figure 16A:
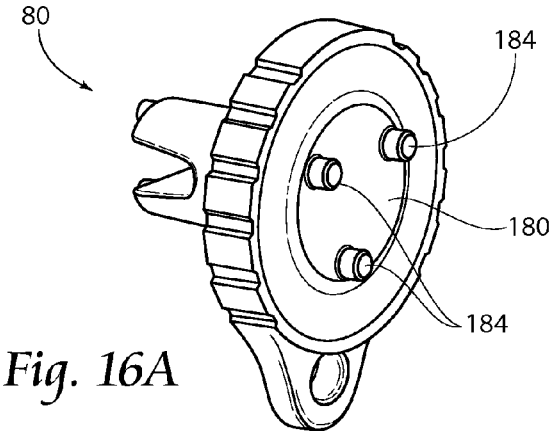
FIGS. 16A and 16B are perspective views of a calibration tool for use with the present device.
Figure 16B:
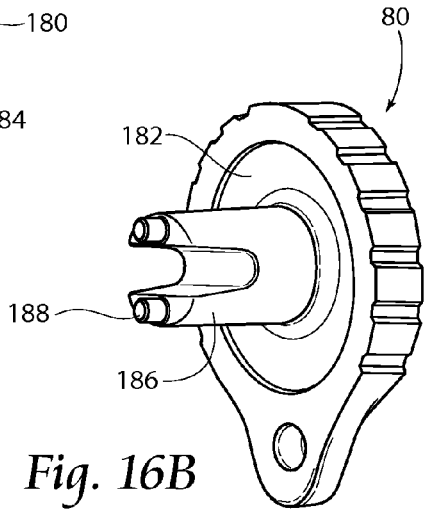

With attention now to FIGS. 15A and 15B, it may be seen that the forwardmost end of the device 10 barrel 16 carries a nosepiece 150. The nosepiece 150 preferably includes a blunt, substantially vertical planar face 151 adapted to butt up against the head 24 of a cable tie 20 (not seen in these views) when the tie 20 is tensioned. The nosepiece 150 further includes an upper, horizontal portion 153 that, in cooperation with the face 151 defines a slot 156 for receiving the tie tail portion 26 of the cable tie 20. As may be further seen, the slot 156 may be open toward the left side of the device 10 so that the tail 26 may be inserted into the device 10 from the side. A nose guide block 152 positioned behind the nose piece 150 defines a lower surface for supporting the underside of the tie tail 26.

As further viewed in FIGS. 15A and 15B, the sharpened blade member 160 is located immediately behind the nose piece 150 and the nose guide block 152. Blade member 160 is confined between a pair of vertical channels 157 defined between the nosepiece 150 and the housing 12 which permit the blade member 160 to reciprocate vertically behind the nosepiece 150. As further seen, the blade member 160 includes a blade link aperture 161 arranged to secure the forward end 119 of the cutter link 118 therethrough and thereby carry the blade member 160 on the cutter link 118 during reciprocation of the cutter link 118 while cutting.

With specific reference to FIG. 15A, it may be seen that the blade member 160 further includes a blade perimeter 158 having a beveled portion 159. As seen, the beveled portion 159 corresponds to a respective beveled area 164 on the housing 12. The blade beveled portion 159 is configured to allow single directional mounting of the blade 160 by the user. This feature alleviates improper blade 160 mounting during replacement or repair. Correct blade 160 mounting further increases the longevity of both the blade member 160 and the tool 10. Further, the beveled portion 159 gives a well understood indication to users of correct blade 160 placement, thereby increasing user efficiency during blade replacement.

Calibration

As mentioned previously, the tension adjustment system may be calibrated at the point of manufacture or may be calibrated in the field. Calibration sets the base tension point from which the further tension adjustments, discussed previously, may be made. During calibration, a calibration tension tool 80 may be used.

Figure 17A:
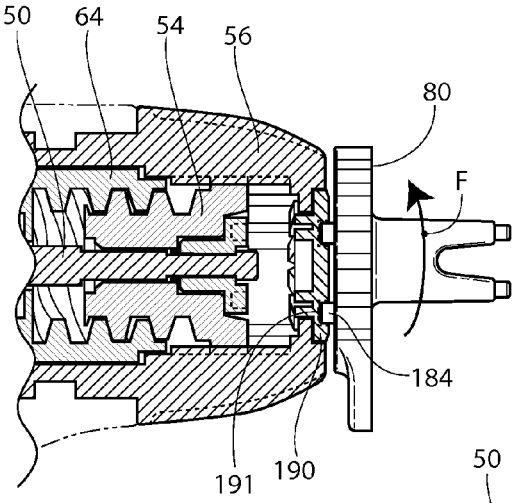
FIGS. 17A and 17B are fragmentary, cross sectional views of the tension adjustment system and use of a tension calibration tool.
Figure 17B:
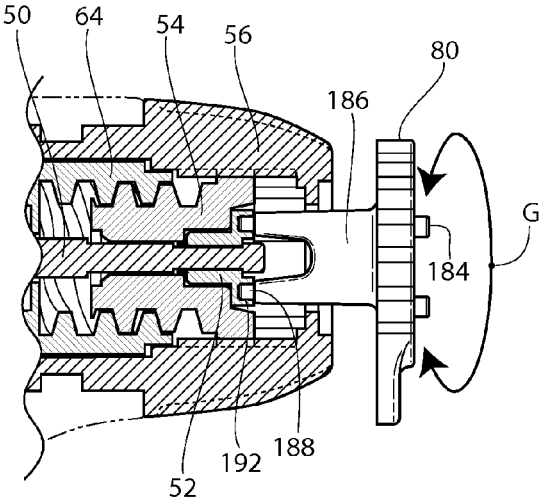

With specific reference to FIGS. 16A-17B, a calibration tension tool 80 for use with the present device 10 may be seen. As seen, the calibration tension tool 80 includes a first side 180 and a second side 182. As viewed particularly in FIG. 16A, the first side 180 preferably includes a plurality of upstanding protuberances 184. Illustrated in FIG. 16B is the second side 182 of calibration tension tool 80 and showing an upstanding, elongate key device 186. As shown, the key device 186 may further include at least one pin portion 188. Use of the calibration tension tool 80 may be viewed in FIGS. 17A and 17B. As seen in FIG. 17A, the first side 180 of calibration tool 80 may be used to remove the calibration cap 190. As seen, the protuberances 184 engage corresponding detents 191 in the calibration cap 190 while the calibration tool 80 rotates in the direction of arrow F to twist off the calibration cap 190. With the calibration cap 190 removed, and as seen in FIG. 17B, the key device 186 on the second side 182 of calibration tool 80 along with pin portions 188 engage the tension calibration nut 52 in corresponding detents 192. The calibration tool 80 is then rotated in the direction of arrow G to thereby rotate the tension shaft 50 and rotating cam 54 to a predetermined tension position. It is to be noted that rotation of the tension shaft 50 may be in clockwise or counterclockwise direction, depending on whether the user wishes to set calibration at a higher or lower set tension.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention.

The invention claimed is:

1. A tool for tensioning and severing an elongate cable tie, said tie having a tie head portion and tie tail portion, the tool including:

a pistol-shaped housing including a handle portion and a barrel portion;

an elongate trigger extending downwardly from the barrel portion, forwardly of the handle portion and displaceable toward and away from the handle portion;

a tensioning mechanism in the barrel portion operable to engage a tie and apply tension to the tie in response to movement of the trigger toward the handle portion;

a locking mechanism in the barrel portion operable to stop application of tension to the tie when tension applied by the tensioning mechanism reaches a predetermined tie tension;

a cutoff mechanism in the barrel portion operable to cut off the tie when the locking mechanism stops tie tensioning;

a tension-lock-cut linkage wherein said linkage includes a pawl link mounted for horizontal, linear reciprocal movement relative to the housing, the pawl link further including a forward end having a pivotally attached tie gripping pawl;

a pawl link actuating structure; and an elongate trigger handle link that extends upwardly into the barrel portion, the trigger handle link including two substantially parallel spaced arms at an upper end, each of said arms including an arm aperture wherein each of the arms is adapted to pivotally mount the trigger handle link for movement around a substantially horizontal pivot axis, wherein a pair of trigger inner links extends upwardly into the barrel portion of the housing alongside the trigger handle link, wherein the trigger inner links each include a lower end, each of said lower ends are pivotally joined to the trigger handle link for pivoting movement around a substantially horizontal pivot axis, and wherein the inner trigger links each include an upper end having an aperture there through, said upper ends supporting a horizontally disposed dog bone cam shaft, said cam shaft being concentrically aligned with the apertures in the upper ends of the trigger handle link and said arm apertures.

2. The tool of claim 1 further including a rack member having a plurality of upstanding teeth, said rack member being affixed to a rearward end of said pawl link.

3. The tool of claim 2 further including a pinion member having a plurality of teeth members adapted to engage the corresponding teeth members in said rack member.

4. The tool of claim 3 wherein said pinion member further includes an upstanding arm member and at least one pivot member, said at least one pivot member being adapted to support a pinion torsion spring, said pinion torsion spring pivotally biasing the pinion member toward a cutoff cam to maintain contact between the upstanding arm member and the cutoff cam.

5. The tool of claim 4 wherein said cutoff cam is pivotally mounted for pivotal movement around a substantially horizontal pivot axis and includes a cradle in an upper surface, said dog bone cam shaft ordinarily resting in said cradle.

6. The tool of claim 5 wherein said cutoff cam includes a pair of spaced apart blocks forming a channel at a rearward portion of said cutoff cam, the channel being adapted to receive said upstanding arm member of said pinion member.

7. The tool of claim 6 wherein said linkage further includes a handle link having an upper end extending upwardly and forwardly toward the rear end of said pawl link.

8. The tool of claim 7 further including a pair of substantially parallel spaced short links pivotally joined at their forward ends to said trigger inner link at a pivot axis.

9. The tool of claim 8 wherein said short links are further joined at their rearward ends to said handle link for pivoting movement around a substantially horizontal axis.

10. The tool of claim 9 wherein said linkage is coupled to a tension adjustment system.

11. The tool of claim 10 further including a U-bracket, said U-bracket coupling said linkage to said tension adjustment system.

12. The tool of claim 11 wherein said U-bracket includes at least one forward end, said at least one forward end being pivotally coupled to the rear end of the cutoff cam.

* * * * *